US007351989B2

(12) United States Patent
Morishige

(10) Patent No.: US 7,351,989 B2
(45) Date of Patent: Apr. 1, 2008

(54) FIBER-REINFORCED CONCRETE CASK, SUPPORTING FRAME FOR MOLDING THEREOF AND PROCESS FOR PRODUCING THE CONCRETE CASK

(75) Inventor: Haruo Morishige, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 315 days.

(21) Appl. No.: 10/518,021

(22) PCT Filed: Aug. 8, 2003

(86) PCT No.: PCT/JP03/10106

§ 371 (c)(1),
(2), (4) Date: Jun. 7, 2005

(87) PCT Pub. No.: WO2004/017330

PCT Pub. Date: Feb. 26, 2004

(65) Prior Publication Data

US 2005/0213698 A1 Sep. 29, 2005

(30) Foreign Application Priority Data

Aug. 14, 2002 (JP) ..... 2002-236621

(51) Int. Cl.
*G21F 5/00* (2006.01)

(52) U.S. Cl. ..... 250/506.1; 250/505.1; 250/507.1; 250/515.1; 376/272

(58) Field of Classification Search ..... 250/506.1, 250/519.1, 505.1, 507.1, 515.1, 517.1, 343, 250/428, 453.1, 496.1; 376/272, 347; 220/62.15, 220/62.22

See application file for complete search history.

(56) References Cited

U.S. PATENT DOCUMENTS 3,309,450 A * 3/1967 William ..... 264/257
5,789,648 A * 8/1998 Roy et al. ..... 588/1
5,814,824 A * 9/1998 Hamby et al. ..... 250/515.1

FOREIGN PATENT DOCUMENTS

| | | |
|---|---|---|
| GB | 1 584 506 | 2/1981 |
| JP | 53-148698 | 12/1978 |
| JP | 55-1591 | 1/1980 |
| JP | 59-85999 | 5/1984 |

(Continued)

*Primary Examiner*—Jack I. Berman
*Assistant Examiner*—Micheal J Logie
(74) *Attorney, Agent, or Firm*—Oblon, Spivak, McClelland, Maier & Neustadt, P.C.

(57) ABSTRACT

The object of this invention is to provide a fiber-reinforced concrete cask that ensures easy working, enables reducing working cost, excels in strength, durability and heat resistance and enables minimizing cracking; a process for fabrication of the same; and a supporting frame for molding the concrete cask. In particular, concrete cask (10) formed through injecting and solidification of concrete (11) is characterized in that sheets of reinforcement fibers having a thermal expansion coefficient equal to or lower than that of concrete (11) are provided on at least the outer circumferential surface and the inner circumferential surface of the concrete cask (10) and that the inner circumferential surface of outer sheet (21) and the outer circumferential surface of inner sheet (22) are connected with each other by strings of reinforcement fibers (23). Preferably, carbon fibers are used as the reinforcement fibers.

11 Claims, 4 Drawing Sheets

FOREIGN PATENT DOCUMENTS

| | | |
|---|---|---|
| JP | 5-8217 | 1/1993 |
| JP | 2000-265435 | 9/2000 |
| JP | 2001-166087 | 6/2001 |
| JP | 2001-296392 | 10/2001 |
| JP | 2001296392 | * 10/2001 |
| JP | 2002-55195 | 2/2002 |

* cited by examiner

FIBER-REINFORCED CONCRETE CASK, SUPPORTING FRAME FOR MOLDING THEREOF AND PROCESS FOR PRODUCING THE CONCRETE CASK

FIELD OF TECHNOLOGY

The present invention relates to a fiber reinforced concrete cask such is used for the transport and storage of radioactive materials, as well as a support frame for molding thereof, and a process for fabrication of the concrete cask.

BACKGROUND TECHNOLOGY

When storing or transporting radioactive substances, generated by nuclear power plants such as spent fuel having a high level of radioactivity and decay heat, the container used to hold this material must have a high radioactivity shielding capability, high seal performance, and have adequate cooling capabilities and structural strength. In general, concrete reinforced with steel rods or sheets has been used to fabricate such containers, but problems remain in the current implementations. One of the problems is the difference in the coefficients of thermal expansion between the concrete and the steel reinforcing materials.

Internally or externally reinforcing concrete using steel materials improves the strength of the container, but since the coefficient of thermal expansion of the steel materials is greater than that of the concrete, if the materials inside the container emit heat, cracks in the concrete could be generated to damage the container. Further, since the heat conductivity of concrete is lower than that of the metal, the additional problem being difficult to dispel heat generated inside the container to the outside exacerbates the above cited differences in their coefficients of thermal expansion even more to increase crack formation.

At this point, JP2000-162384A discloses a concrete cask which prevents the concrete cask container itself from reaching high temperatures.

As is shown in FIG. 4, the concrete cask 51 is comprised of concrete 55 formed to a cylindrical shape with a bottom, and an inner metal cylinder 56 on the inside circumference of container unit 53. Then, canister 52 is inserted into the container and the top opening is sealed by lid 54. A space 57 for the circulation of cooling air is disposed between the outside surface of canister 52 and container unit 53 and cooling air supply passages 58 and cooling air exhaust passages 59 are formed to connect thereto.

Thus, the structure enables cooling air to exhaust the heat from the inside of the container unit to the outside to thereby improve the durability and heat resistance of the container.

It is further disclosed to use a metal such as stainless steel, which has a coefficient of thermal expansion approximately equivalent to that of the concrete, to form the inner metal cylinder 56 as a reinforcing material for the concrete cask, as a means to minimize any damage to the cask and help it maintain its strength.

Further, JP2000-265435A discloses the use of polyethylene or other fiber sheets as a support frame instead of using steel as a reinforcing material to thereby simplify fabrication and reduce fabrication costs for concrete structures. According to this cited invention, a jacket would be formed from an outer sheet and inner sheet with a space disposed between them, and then the jacket would be immersed into the sea so as to introduce sea water into the space in the jacket, which would then be filled with concrete, which would displace the water, and be subsequently allowed to solidify to complete the structure.

However, just as is the case with the above cited JP2000-162384A, by simply forming passages for the flow of cooling air, when used to contain a high temperature heat emitting material with a high heat output, differences in the coefficients of thermal expansion of the materials could not be absorbed, and cracking would be inevitable. Further, not only does the use of stainless steel materials as disclosed make the fabrication more difficult, but it also entails much higher material costs.

On the other hand, while concrete structures according to the foregoing Patent Publication 2000-265435 would be suitable for holding low temperature materials, the use of polyethylene, or other fiber sheets for the support frame poses problems in the areas of both strength and heat resistance.

DISCLOSURE OF THE INVENTION

The present invention was developed after reflecting upon the problems associated with the prior art. The object of this invention is to provide a fiber-reinforced concrete cask that ensures easy working, enables reducing working cost, excels in strength, durability and heat resistance and enables minimizing cracking; a process for fabrication of the same; and a support frame for molding the concrete cask.

To resolve the above problems the present invention is characterized in that the fiber reinforced concrete cask is formed by injecting and solidifying concrete wherein reinforcement fiber sheets are disposed at least on an outside circumference surface of said cask, and said reinforcement fiber sheets have a coefficient of thermal expansion equivalent to or less than that of the concrete.

In this case, the reinforcement fiber sheets are preferably disposed on both the outside circumference surface and the inside circumference surface of said concrete cask, and said reinforcement fiber sheets on said outside and inside circumference surfaces are connected with strings.

Further, the reinforcement fiber sheets are preferably carbon fibers.

According to the invention disclosed above, it is possible to fabricate concrete casks having superior durability and heat resistance without the cracking or dissociation from the reinforcement material seen in the prior art that was caused by expansion or pulling away from the concrete of the steel reinforcement materials or frames utilized in the casks that were caused by heat generation from the cask's contents.

Additionally, the present invention is characterized in that the fiber reinforced concrete cask is formed by injecting concrete into and solidifying within a cylindrical bag support frame formed from reinforcement fiber sheets that have a coefficient of thermal expansion equivalent to or less than that of the concrete. What is meant by the aforementioned "cylindrical bag," are bag-shaped cylindrical structures that include hollow cylindrical shapes, hollow cylindrical shapes with a bottom (a cylindrical container), and structures where the base plate includes true cylindrical forms.

Further, through the use of carbon fibers that have a negative coefficient of thermal expansion as the foregoing reinforcement fibers, such carbon fibers contract in response to rising temperatures from the heat generated inside the cask to exert compression force upon the concrete, which is weak with respect to tensile forces, but strong with respect to compression forces, thereby making it possible to dramatically improve the strength of the concrete.

It is necessary that the foregoing reinforcement fibers are strong enough to withstand the injection of the concrete, and that the fibers have sufficiently high heat resistance to withstand the heat from heat-emitting materials. It is further preferable that the aforementioned strings are formed from reinforcement fibers such as carbon fibers.

Further still, the present invention is characterized in that the support frame is made from reinforcement fiber sheets having a coefficient of thermal expansion that is equivalent to or less than that of the concrete.

Also, it is further preferable in this invention that the support frame has a double walled structure made from said reinforcement fiber sheets comprising an outer sheet and an inner sheet joined together, and said outer sheet and inner sheet are joined by strings, and the support frame is sewn together into a cylindrical bag shape, and made from reinforcement fiber sheets.

As previously stated, what is meant by "cylindrical bag" shaped includes bag-shaped cylindrical structures that include hollow cylindrical shapes, hollow cylindrical shapes with a bottom (a cylindrical container), and structures where the base plate includes true cylindrical forms.

According to this invention, it is possible to form a support frame for the concrete cask that will deliver the aforementioned operational effects of this invention. It is further preferable that a concrete injecting input opening is located in the lower part of the foregoing support frame according to the present invention.

The preferred method for the fabrication of a concrete cask according to the present invention is characterized in that it includes the processes: forming a support frame for injection of the concrete, using reinforcement fiber sheets having a coefficient of thermal expansion equivalent to or less than that of the concrete, and injecting the concrete into said support frame. The process for forming the foregoing support frame includes preferably the joining of the outer sheet and inner sheet of reinforcement fibers comprising said support frame with strings.

By doing so, although tensile forces remain in the sheets of the support frame from the pressure exerted upon them during the injection of the concrete, since the concrete exhibits no resiliency after it has cured, said sheets then contract, which puts a compressive pre-stress on the concrete from the outside. This makes it possible to effectively use a concrete structure which is characteristically weak to the tensile force but strong to the compression force.

It is further preferable following the process to form the foregoing support frame, to include a process for filling said formed support frame with a fluid that will maintain a shape of said support frame, and a process for injecting the concrete from a bottom of said support frame in said concrete injecting process to replace said fluid previously filled into said support frame to hold said shape, with the concrete.

The fluid used to maintain the shape of the foregoing support frame should be, for ease of operations, one with a lower specific gravity than the concrete and easy-care such as water, air, etc.

According to this invention, by pre-filling the support frame with a fluid to hold its shape and by replacing it with concrete, it is possible to fabricate the concrete cask to accurate dimensions without the necessity of taking the trouble to prepare a mold frame such as a steel frame.

To wit, the present invention not only makes it possible to ease fabrication and lower fabrication costs, but the invention can provide the concrete cask which additionally makes it possible to improve the strength, durability and heat resistance and to minimize any crack generation.

A PREFERRED EMBODIMENT OF THE PRESENT INVENTION

Embodiments of the present invention will be described below with the reference of the attached drawings. In these embodiments, unless otherwise stated, any specific mention of such details as the dimensions, materials, or relative positioning of any of the component parts should not be construed as to limit the scope of this invention; they are merely included for purposes of explanation.

Figure 1:
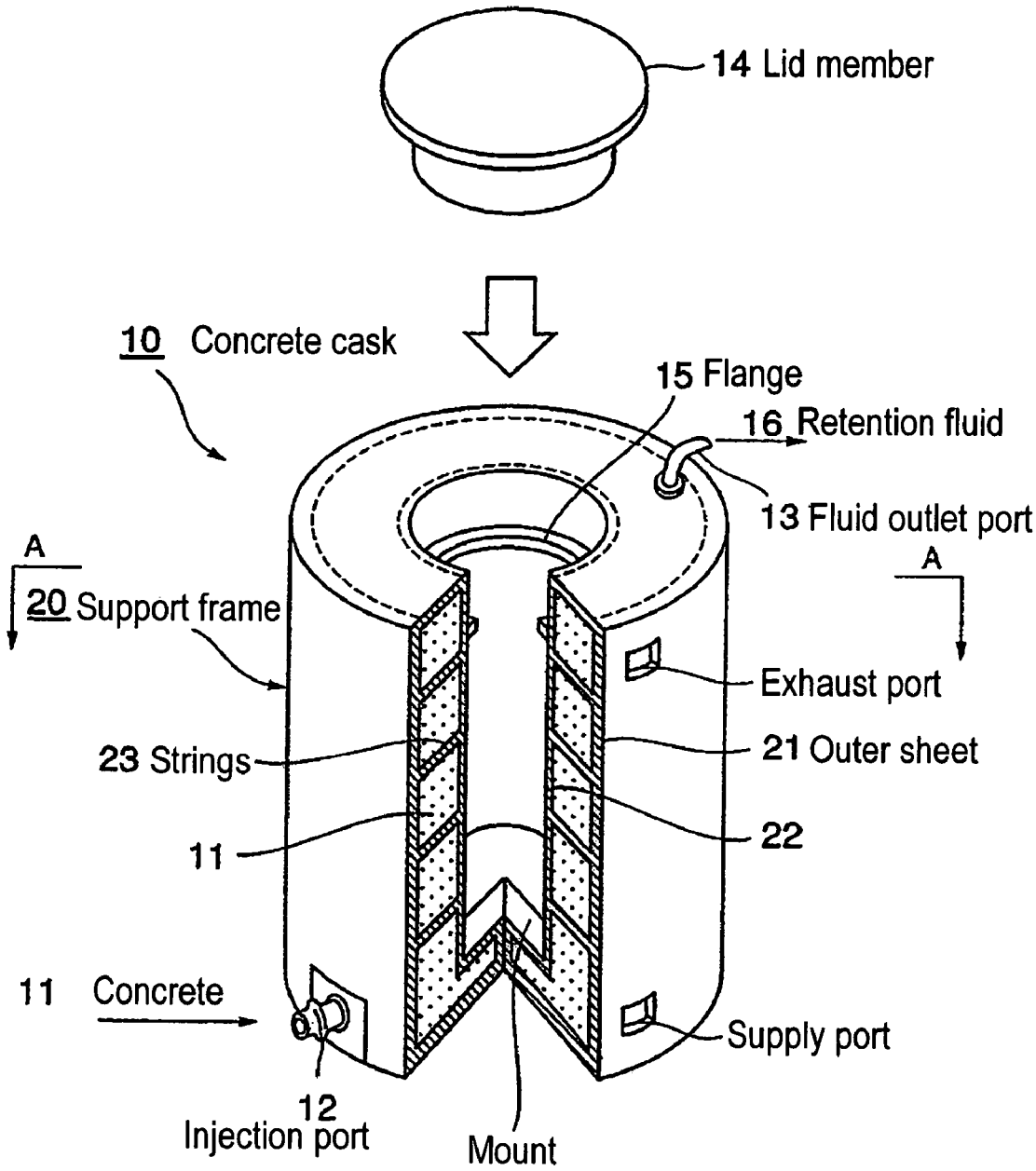
FIG. 1 shows a perspective view of an embodiment of a fiber reinforced concrete cask according to the present invention.
Figure 2:
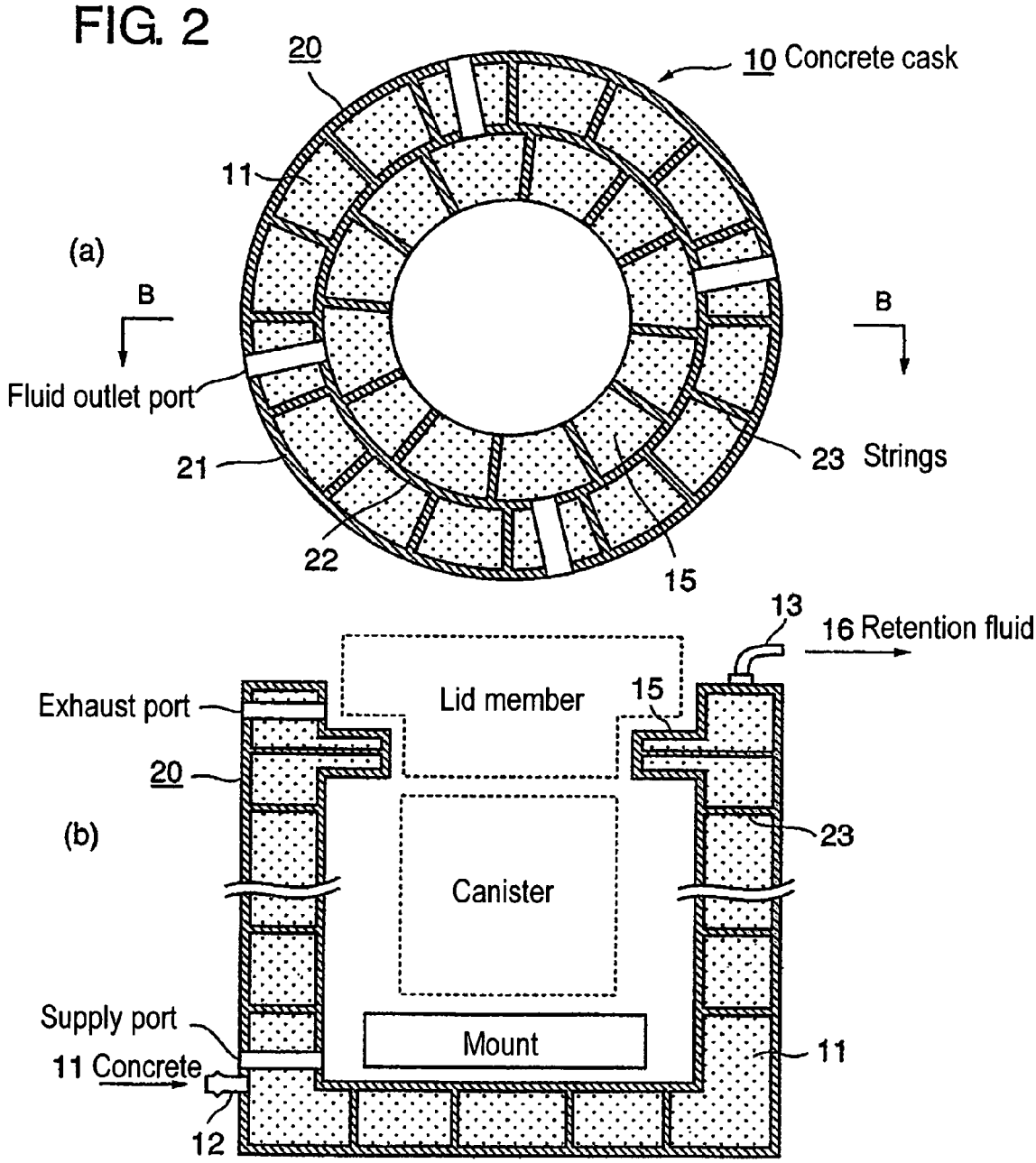
FIG. 2 shows sectional views: (a) a sectional view along line A-A of FIG. 1, and (b) a sectional view along line B-B of FIG. 2(*a*).
Figure 3:
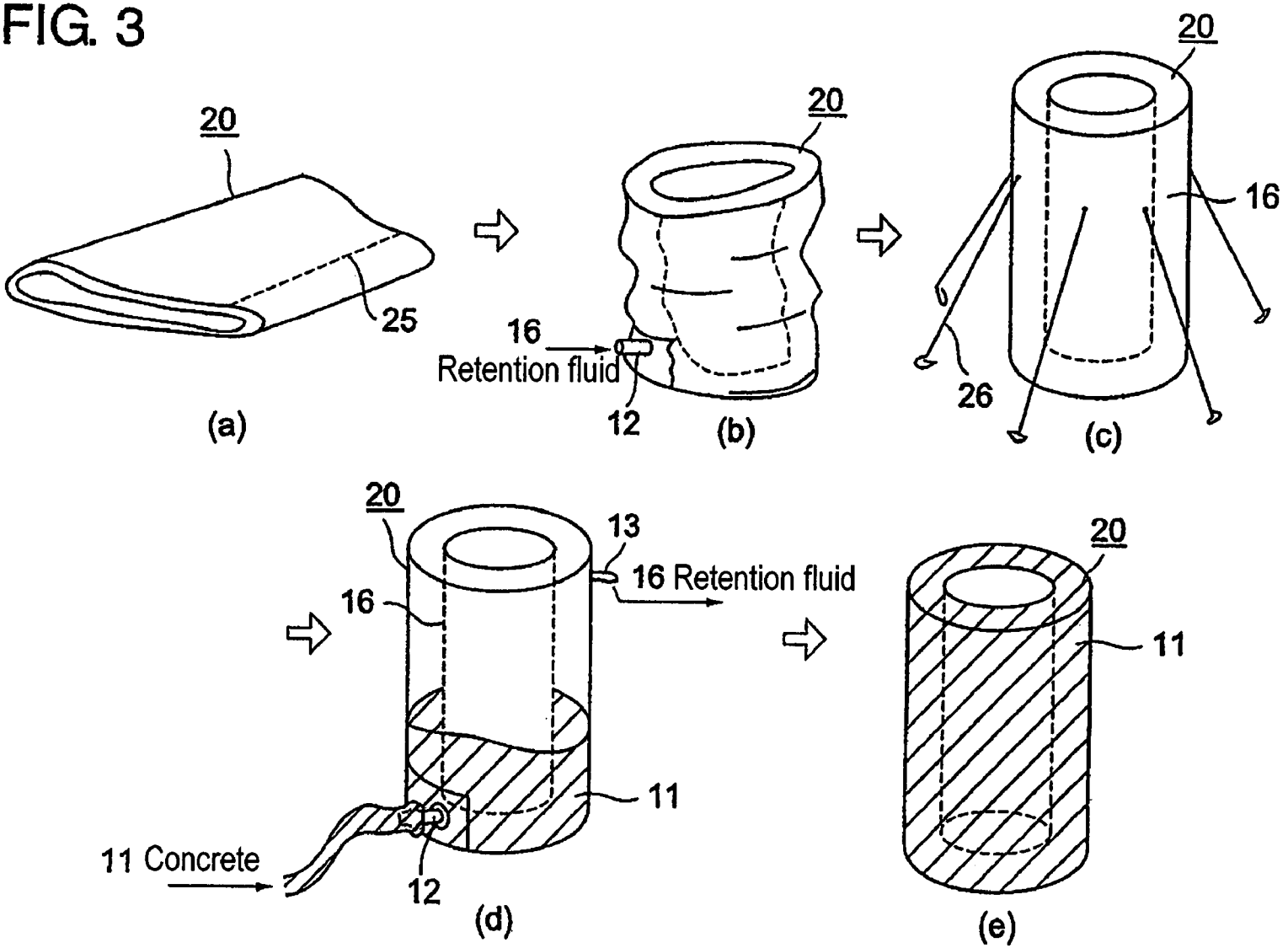
FIG. 3 is a diagram showing the fabrication process for this embodiment of a fiber reinforced concrete cask according to the present invention.
Figure 4:
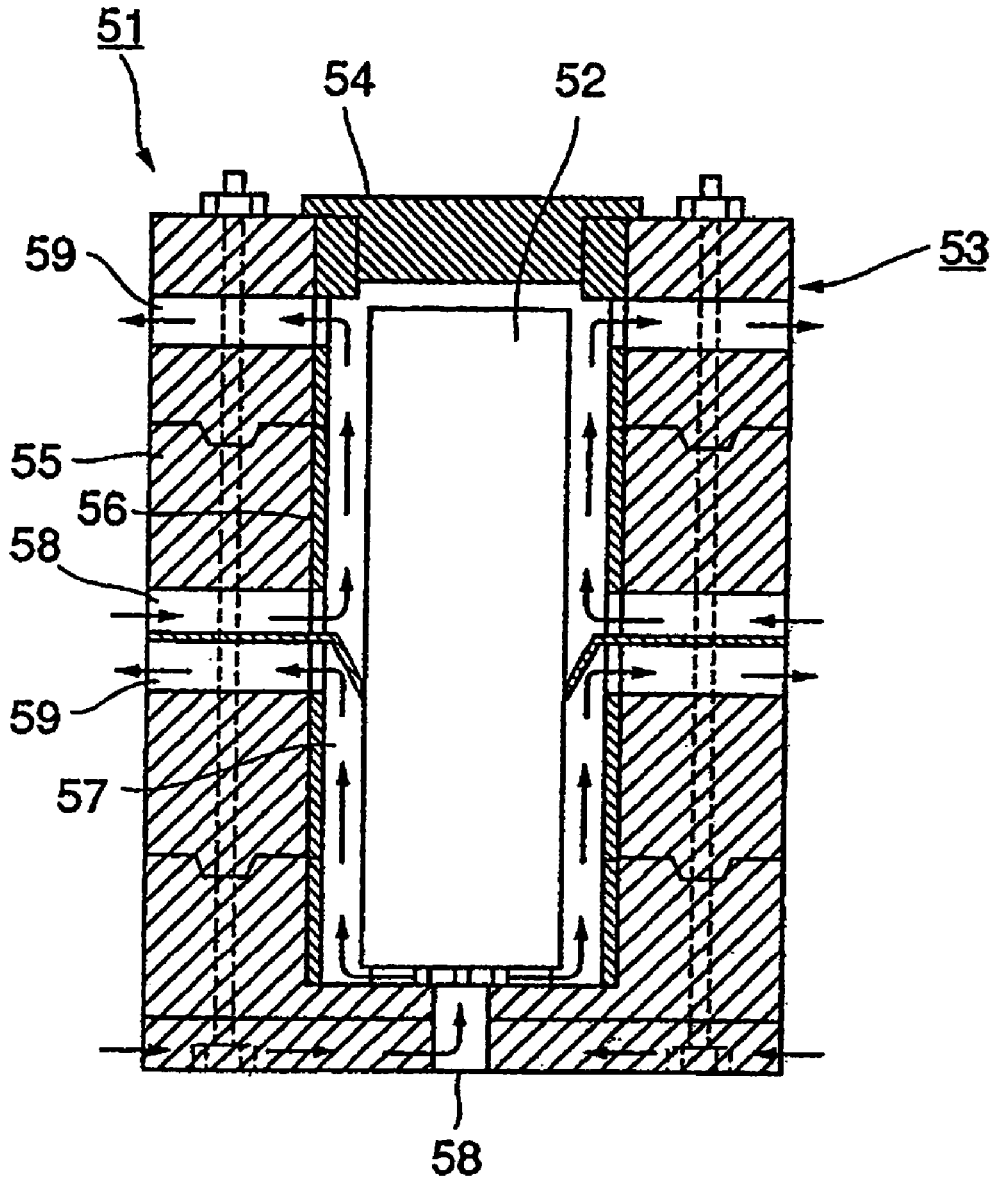
FIG. 4 shows a perspective outer view of a concrete cask according to the prior art.

FIG. 1 shows a perspective view of an embodiment of a fiber reinforced concrete cask according to the present invention; FIG. 2 shows sectional views: (a) a sectional view along line A-A of FIG. 1, and (b) a sectional view along line B-B of FIG. 2(*a*); and FIG. 3 is a diagram showing the fabrication process for this embodiment of a fiber reinforced concrete cask according to the present invention.

This embodiment of a fiber reinforced concrete cask would be used as a container to store or transport radioactive material generated in a nuclear power plant such as spent fuel, recycled fuel, etc.

In FIG. 1 and FIGS. 2(*a*) and (*b*), fiber reinforced concrete cask 10 according to the present embodiment is comprised of support frame 20, formed by sewing together an outer sheet 21 and a smaller diameter inner sheet 22 into a cylindrical shaped bag having a bottom, and concrete 11 contained in the bag. Although not shown in the figures, its structure is such that it can contain a canister holding radioactive materials. Further, in order to facilitate shape retention of the foregoing support frame 20, a plurality of strings 23 join the inside circumference of the foregoing outer sheet 21 with the outside circumference of inner sheet 22.

Reinforcement fibers are used in the foregoing outer sheet 21, inner sheet 22 and strings 23. Said reinforcement fibers, at least for outer sheet 21, must have a coefficient of thermal expansion equivalent to or less than that of thermal expansion of the concrete. To wit, if the concrete used to fill support frame 20 has a thermal expansion coefficient ranging from about 0.5 to $1.5\times10^{-5}$/° C., the reinforcement fibers used for support frame 20 must have a coefficient of thermal expansion equal to or less than approximately $1.5\times10^{-5}$/° C. It is preferable that the reinforcement fibers can be high strength, heat resistant fibers having a negative coefficient of thermal expansion, such as carbon fibers. It is, of course, preferable to use high strength fibers with the aforementioned properties for the foregoing inner sheet 22 and the strings 23 as well.

Further, the foregoing support frame 20 should have an injection port 12 in the lower part thereof as well as a fluid outlet port 13 in the upper part thereof. The foregoing injection port 12 should be of a structure which can be connected to the supply hose of the concrete to be injected into the support frame, and when the concrete is injected, the supply hose and the foregoing injection port 12 are sealed off with a hose clamp.

On the other hand, the fluid outlet port 13 should preferably be equipped with a cock or other type of valve to facilitate the below described expelling of the shape retention fluid, and to make it possible to seal off the inside of the foregoing support frame with the forgoing valve.

Further, a plurality of strings 23, which help the foregoing support frame 20 hold its shape, should be installed in the circumferential and in the height directions of said support frame 20; the number installed should be the number required for the support frame to retain its shape when it is filled with concrete.

Further, flange 15 is fabricated in the top inside circumference of the foregoing concrete cask 10, which can accommodate the insertion of lid member 14. Said flange 15 is preferably formed as a projection on the inside circumference of the foregoing inner sheet 22 by filling it with concrete 11, and lid member 14 can be formed by filling a bag-shaped lid frame made from reinforcement fibers with concrete 11 in a manner similar to that described above for support frame 20.

Also, in the present embodiment, concrete cask 10 is a unitized hollow cylinder having a bottom, but the body of the hollow cylindrical shape and the bottom of the cylinder and the lid also may be comprised of 3 respective blocks, or an even greater number of blocks, that are individually fabricated and joined together to form a unitized concrete cask.

Further, it is also preferable that there are air supply ports and exhaust ports established in the sides of concrete cask 10 to accommodate the supply and exhausting of the air that is circulated in the space between the inside circumferential wall of said concrete cask and the outside of the canister contained within concrete cask 10.

Using the above described structure, even if heat generated inside the foregoing canister causes concrete 11 to expand, the support frame 20, which has a coefficient of thermal expansion that is less than that of said concrete, protects the concrete and generates the special effect of increasing its compression strength as a tradeoff for weakened tensile strength.

Further, by using carbon fibers as the foregoing reinforcement fibers, it is possible to provide concrete casks 10 having excellent strength and heat resistance.

Next, the fabrication method for the fiber reinforced concrete cask of the present embodiment will be described with reference to FIG. 3.

First, as shown in FIG. 3(*a*), the outer sheet and inner sheet of carbon or other reinforcement fibers are sewn together. The reinforcement fibers, as explained above, must have a coefficient of thermal expansion that is equivalent to or less than that of concrete, and additionally, they must be strong and resistant to heat. Sheets of reinforced fibers woven to the required size, or rectangular shaped sheets blocks of the appropriate size are sewn together to create cylindrical shaped sheets.

The diameter of the inner sheet is smaller than the diameter of the outer sheet by an amount equivalent to the desired thickness of the cask. It would also be possible to bind with adhesives or fuse the reinforcement fiber sheets instead of sewing them together. Also, the outside circumferential surface of inner sheet 22 is joined with the inside circumferential surface of outer sheet 21 by a plurality of strings 23, also made from reinforcement fibers, and in addition, a bottom made from circle-shaped reinforcement fiber sheet is sewn together with the sheets, and a ring-shaped reinforcement fiber sheet is sewn to the top of the sheets for fabricating the bag-shaped support frame.

Then, as shown in FIG. 3(*b*), a support frame shape retention fluid 16 is injected through injection port 12 in the bottom of the foregoing support frame 20. To facilitate operations, said fluid should be one which has a lower specific gravity than the concrete such as air or water and also easy-care, and it should be one which easily separates out from the concrete. Then, as shown in FIG. 3(*c*), with the support frame 20 filled with said fluid 16, stays 26 are attached to facilitate its shape retention as well as to prevent its falling over.

Next, as shown in FIG. 3(*d*), a concrete supply pump is connected to the foregoing injection port 12 and concrete 11 is injected. At the same time, the valve at the fluid outlet port 13 installed on the top of support frame 20 is opened to allow the fluid 16 to be expelled. Thus, as concrete 11 is inserted from the bottom, the lower specific gravity fluid is output from the top, until concrete has replaced all of fluid 16 inside support frame 20 as shown in FIG. 3(*e*).

When the concrete injecting into said support frame 20 has been completed, the injection of concrete is halted and it is allowed to cure for the required period of time. Thus, with the solidification of concrete 11 inside support frame 20, the fabrication of the concrete cask is completed.

The use of this method makes it possible to simplify fabrication and reduce fabrication costs in producing concrete casks that provide excellent heat resistance and strength.

When using water as the fluid 16 for retaining the shape of the support frame, it is preferable to use a type of concrete materials for concrete 11 that exhibits very little separation in aqueous environments.

EFFECTS OF THE INVENTION

According to this invention disclosed above, it is possible to fabricate concrete casks having superior durability and heat resistance without the cracking or dissociation from the reinforcement material seen in the prior art that was caused by expansion or pulling away from the concrete of the steel reinforcement materials or frames utilized in the casks that were caused by heat generation from the cask's contents.

Further, through the use of carbon fibers that have a negative coefficient of thermal expansion as the foregoing reinforcement fibers, such carbon fibers contract in response to rising temperatures from the heat generated inside the cask to exert compression force upon the concrete, which is weak with respect to tensile forces, but strong with respect to compression forces, thereby making it possible to dramatically improve the strength of the concrete.

By doing so, although tensile forces remain in the sheets of the support frame from the pressure exerted upon them during the injection of the concrete, since the concrete exhibits no resiliency after it has cured, said sheets then contract, which puts a compressive pre-stress on the concrete from the outside. This makes it possible to effectively use a concrete structure which is characteristically weak to the tensile force but strong to the compression force.

To wit, the present invention not only makes it possible to ease fabrication and lower fabrication costs, but the invention can provide the concrete cask which additionally makes it possible to improve the strength, durability and heat resistance and to minimize any crack generation.

The invention claimed is:

1. A fiber reinforced concrete cask formed by injecting into and solidifying concrete within a support frame, wherein reinforcement fiber sheets are disposed at least on an outside circumference surface of said cask, said reinforcement fiber sheets have a coefficient of thermal expansion less than a coefficient of thermal expansion of the concrete, and said support frame is sewn together into a cylindrical bag shape and made from reinforcement fiber sheets.

2. The fiber reinforced concrete cask according to claim 1, wherein said reinforcement fiber sheets are disposed on both the outside circumference surface and the inside circumference surface of said concrete cask, and said reinforcement fiber sheets on said outside and inside circumference surfaces are connected with strings.

3. The fiber reinforced concrete cask according to claim 1, wherein said reinforcement fiber sheets are carbon fibers and sewn together into the cylindrical bag shape to form bag-shaped cylindrical structures, and said bag-shaped cylindrical structures include hollow cylindrical shapes, hollow cylindrical shapes with a bottom, and structures where a base plate includes cylindrical forms.

4. The fiber reinforced concrete cask according to claim 1, wherein said support frame has an injection port in a lower part of said support frame.

5. A support frame for forming a concrete cask, wherein said support frame is made from reinforcement fiber sheets having a coefficient of thermal expansion that is less than a coefficient of thermal expansion of concrete used to form the concrete cask, and said support frame is sewn together into a cylindrical bag shape and made from the reinforcement fiber sheets.

6. The support frame for forming the concrete cask according to claim 5, wherein said support frame has a double walled structure made from said reinforcement fiber sheets comprising an outside sheet and an inside sheet joined together, and said outside sheet and inside sheet are joined by strings.

7. The support frame for forming the concrete cask according to claim 5, wherein said support frame has an injection port in a lower part of said support frame.

8. A method of fabricating a concrete cask, comprising:

forming a support frame for injection of concrete, using reinforcement fiber sheets having a coefficient of thermal expansion less than a coefficient of thermal expansion of the concrete, and injecting the concrete into said support frame.

9. The method of fabricating the concrete cask according to claim 8, wherein the forming the support frame includes using reinforcement fiber sheets that include an outside sheet and an inside sheet joined together by reinforcement fiber strings.

10. The method for the fabrication of fabricating the concrete cask according to claim 8, further comprising filling said formed support frame with a fluid that will maintain a shape of said support frame, and wherein the injecting the concrete is performed after the filling the formed support frame with the fluid and includes injecting the concrete from a bottom of said support frame to replace said fluid, which is pre-filled into said support frame to hold said shape, with the concrete.

11. The method of fabricating the concrete cask according to claim 8, wherein said injecting the concrete is performed so that tensile forces remain in said reinforcement fiber sheets of said support frame from pressure exerted upon said sheets during said injecting the concrete.

* * * * *